US006146056A

United States Patent [19]

Calandra, Jr.

[11] Patent Number: 6,146,056

[45] Date of Patent: Nov. 14, 2000

[54] CHANNEL AND BEARING PLATE ASSEMBLY

[75] Inventor: Frank Calandra, Jr., Pittsburgh, Pa.

[73] Assignee: Jennmar Corporation, Pittsburgh, Pa.

[21] Appl. No.: 09/229,709

[22] Filed: Jan. 13, 1999

Related U.S. Application Data

[60] Provisional application No. 60/071,441, Jan. 14, 1998.

[51] Int. Cl.[7] ..... E21D 21/00; F16B 43/00

[52] U.S. Cl. ..... 405/302.1; 405/288; 411/545; 411/531

[58] Field of Search ..... 411/545, 531, 411/544, 539; 405/302.1, 302.2, 302.3, 303, 288

[56] References Cited

U.S. PATENT DOCUMENTS

| | | | |
|---|---|---|---|
| Re. 35,902 | 9/1998 | Calandra, Jr. et al. | 405/302.1 |
| 2,854,824 | 10/1958 | Curry et al. | 61/45 |
| 3,090,203 | 5/1963 | Durget | 61/45 |
| 3,224,202 | 12/1965 | Durget | 405/302.1 |
| 4,037,418 | 7/1977 | Hannan | 405/302.1 |
| 4,249,835 | 2/1981 | White | 405/259 |
| 4,439,065 | 3/1984 | Constapel | 405/151 |
| 4,498,815 | 2/1985 | Dye | 405/259 |
| 4,507,020 | 3/1985 | Zeitler et al. | 405/259 |
| 4,708,559 | 11/1987 | Locotos | 405/302.1 |
| 5,292,209 | 3/1994 | Calandra, Jr. et al. | 405/302.1 |
| 5,385,433 | 1/1995 | Calandra, Jr. et al. | 405/302.1 |
| 5,791,828 | 8/1998 | Fergusson | 405/302.1 |

FOREIGN PATENT DOCUMENTS

| | | | |
|---|---|---|---|
| 6747581 | 5/1983 | Australia . | |
| 4464785 | 1/1986 | Australia . | |
| 665515 | 1/1996 | Australia . | |
| 1168459 | 6/1984 | Canada | 61/66 |
| 9-41331 | 10/1959 | France . | |
| 1222640 | 6/1960 | France | 405/302.1 |
| 2075090 | 11/1981 | United Kingdom . | |

OTHER PUBLICATIONS

"Jennmar's #5 mine Steel Roof Channels", Frank Calandra Inc. (1 p.) (undated).

"W Straps", Arnalls Engineering Pty. Limited (1 p.) (undated).

*Primary Examiner*—Eileen D. Lillis
*Assistant Examiner*—Frederick L. Lagman
*Attorney, Agent, or Firm*—Webb Ziesenheim Logsdon Orkin & Hanson, P.C.

[57] ABSTRACT

A double ribbed bearing plate for use with a channel member in supporting a mine roof. The bearing plate includes a base with ribs in the bearing plate define recesses which receive flanges on the channel. The longitudinal edges of the bearing plate may extend below the plane of the base. When installed on a mine roof, the longitudinal edges may be spread apart upon changes in the load applied by the mine roof.

23 Claims, 7 Drawing Sheets

CHANNEL AND BEARING PLATE ASSEMBLY

RELATED APPLICATIONS

This application claims the benefit of U.S. Provisional Application Ser. No. 60/071,441 filed Jan. 14, 1998 entitled "Improved Channel Plate."

BACKGROUND OF THE INVENTION

1. Field of the Invention

The present invention relates to an improved channel member and bearing plate assembly, in particular, to a channel member and a bearing plate capable of supporting a large area of a mine roof.

2. Prior Art

In underground mining, excavation and tunneling operations, it is conventional practice to support the overhead and lateral rock strata by elongated structural members such as metal roof mats and channel members that extend transversely across the mine roof and downwardly along the lateral side walls. The mats and channel members are provided in various lengths with holes spaced at a preselected distance apart through the members to conform to a conventional roof bolt plan. Roof bolts extend through the holes in the channel members and into holes drilled in the rock strata and are anchored in the strata to maintain the channel members compressed against the surface of the rock strata.

Bearing plates such as that disclosed in U.S. Pat. No. RE. 35,902 to Calandra, Jr. et al. typically are seated in overlying relation with the channel member so the compressive forces of the roof bolt are distributed by the bearing plate across the channel member. The surface of the bearing plate does not extend beyond the surface of the channel member.

In certain geological conditions, a large area of the mine roof must be supported by channel members. Conventional channel members which are typically about 5 inches wide are insufficient to support large areas of the mine roof or lateral side walls. In those conditions, wood timbers are used but they are bulky, cumbersome and expensive due to the increasing price of lumber. Accordingly, a need remains for wider channel members and/or complementary wider bearing plates which can support a greater area of a mine roof.

SUMMARY OF THE INVENTION

This need is met by a bearing plate made in accordance with the present invention. In a first embodiment, the bearing plate includes a planar body portion having a contact surface for abutting a planar surface and an outer surface on an opposite side of the body portion. The body portion defines an opening through the bearing plate. A pair of spaced apart peripheral ribs are formed in the body portion, and each peripheral rib extends outwardly from the outer surface thereby defining a recess. The bearing plate includes a pair of legs, each leg being integrally formed with one of the peripheral ribs. A flange extends angularly from each of the legs and has a flange bearing surface for engaging a rock formation. The flanges may each extend to a depth below the contact surface, or the flanges may each extend to a depth above the contact surface.

The bearing plate may further include a central inner rib formed in the body portion and positioned between the pair of peripheral ribs, wherein the opening is defined in the central rib. The peripheral ribs preferably are spaced about five and one-half inches apart and each extend a greater distance from the outer surface than the central rib extends from the outer surface.

Alternatively, the bearing plate may include a plurality of inner ribs formed in the body portion at spaced apart positions between the peripheral ribs such that the opening is defined in the body portion at a position between the inner ribs. The peripheral ribs preferably are spaced about nine inches apart and each extend a greater distance from the outer surface than each inner rib extends from the outer surface.

The present invention also includes a mine roof support assembly having a) an elongated member having (i) a base portion, and (ii) a pair of longitudinal flanges on opposite sides of the base portion, the base portion having a bearing surface and a receiving surface and defining an opening through the elongated member, b) a bearing plate having (i) a planar body portion, the body portion including a contact surface for abutting the receiving surface and an outer surface on an opposite side of the body portion, the body portion defining an opening through the bearing plate, the body portion opening aligned with the elongated member opening, (ii) a pair of spaced apart peripheral ribs formed in the body portion, each peripheral rib extending outwardly from the outer surface and defining a recess configured to receive one of the elongated member flanges, and (iii) a pair of legs, each leg integrally formed with one of the peripheral ribs and c) an anchor extending through the aligned openings and configured to be inserted into a borehole in a rock formation for engaging the bearing plate and the elongated member with the rock formation to support a load applied by the rock formation. The bearing plate further includes a pair of flanges. Each flange extends angularly from one of the legs and has a flange bearing surface for engaging the rock formation.

The elongated member further includes a central rib formed in the base portion and the bearing plate further comprises a central rib formed in the body portion in a configuration complementary to the elongated member central rib such that the aligned openings are defined in the respective central ribs. The bearing plate peripheral ribs and the elongated member longitudinal flanges each extend greater distances from the bearing plate outer surface than the central rib extends from the bearing plate outer surface.

In an alternative embodiment, the elongated member further includes a plurality of inner ribs formed in the base portion and the bearing plate includes a plurality of inner ribs formed in the body portion. The bearing plate inner ribs having configurations complementary to the elongated member inner ribs, and the aligned openings are defined in the base portion and the body portion between the respective inner ribs.

The bearing plate peripheral ribs and the elongated member longitudinal ribs preferably each extend greater distances from the bearing plate outer surface than the bearing plate inner ribs extend from the bearing plate outer surface. The bearing plate peripheral ribs are each configured to spread thereby widening the recesses when the bearing plate engages with the rock formation and a load is applied thereto.

The present invention further includes a method of supporting a rock formation having the steps of (i) positioning a bearing plate in overlying abutting relation with an elongated member, the bearing plate and the elongated member each having an aligned opening therethrough and the bearing plate having a pair of peripheral ribs formed therein, the ribs each defining a recess; (ii) positioning longitudinal flanges on opposing sides of the elongated member within the recesses in the bearing plate; and (iii) extending an anchor through the aligned openings in the bearing plate and urging the elongated member into engagement with the rock formation thereby urging the bearing plate into contact with a surface of the rock formation. The bearing plate includes flanges integrally formed with the peripheral ribs, the flanges having bearing surfaces which contact the rock formation surface such that the recesses widen upon urging the bearing plate into contact with the rock formation surface. The method may further include a step of urging a surface of the elongated member into contact with the rock formation surface.

The present invention further includes a method of indicating the amount of load applied by a supported rock formation having the steps of (i) positioning a bearing plate in overlying abutting relation with an elongated member, the bearing plate having a pair of peripheral ribs therein, the peripheral ribs each defining a recess and being integrally formed with a pair of bearing surfaces for engaging a rock formation, the elongated member having a pair of opposing longitudinal flanges, the bearing plate and the elongated member each having an aligned opening therethrough; (ii) positioning the longitudinal flanges within the recesses in the bearing plate; (iii) extending an anchor through the aligned openings in the bearing plate and the elongated member into engagement with the rock formation thereby urging the bearing surfaces of the bearing plate and the bearing surface of the elongated member into contact with a surface of the rock formation; (iv) determining a first configuration of the bearing plate recesses; (v) allowing the load of the rock formation to shift thereby inducing a second configuration of the bearing plate recesses; and (vi) comparing the change between the first recess configuration and the second recess configuration to a predetermined standard for a load required to affect the change.

A complete understanding of the invention will be obtained from the following description when taken in connection with the accompanying drawing figures wherein like reference characters identify like parts throughout.

DESCRIPTION OF THE PREFERRED EMBODIMENTS

Figure 1:
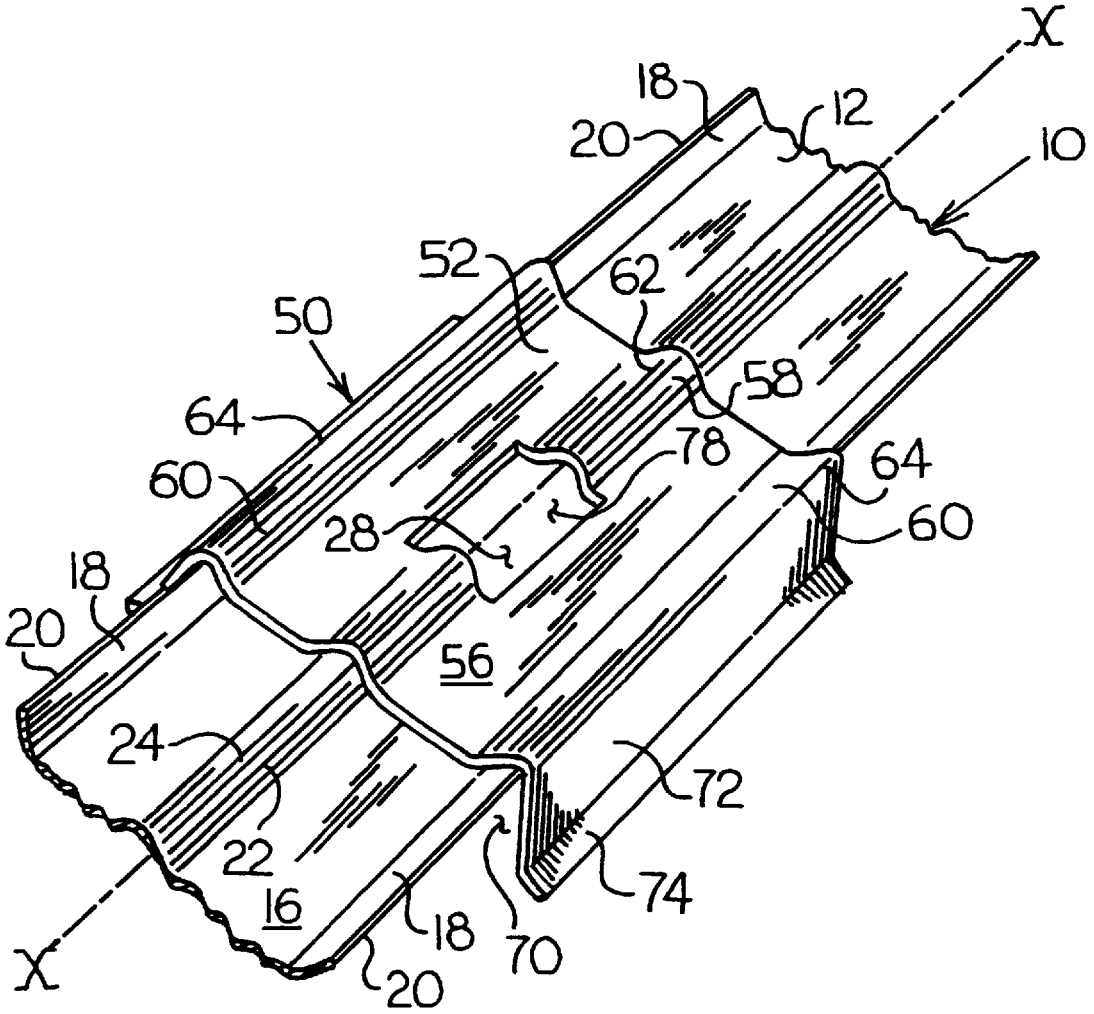
FIG. 1 is a top perspective view of a channel member made in accordance with the present invention in overlying abutting relation with a bearing plate made in accordance with the present invention.

For purposes of the description hereinafter, the terms "upper," "lower," "right," "left," "vertical," "horizontal," "top," "bottom" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

FIGS. 1–5 depict an elongated channel member 10 and a bearing plate 50 made in accordance with the present invention.

Figure 5:
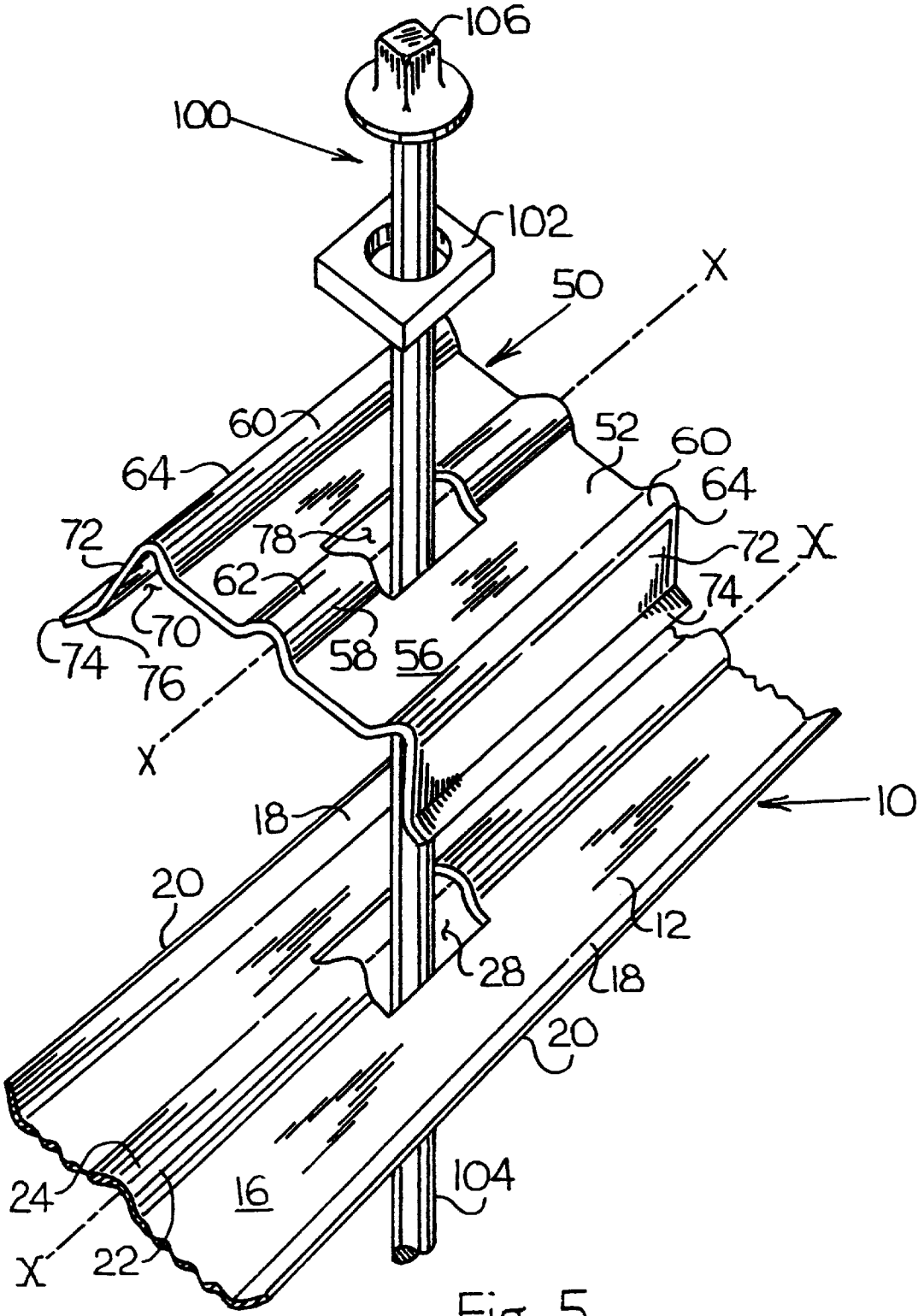
FIG. 5 is an exploded perspective view of an assembly of an anchor bolt and a washer with the channel member and the bearing plate depicted in FIG. 1.

The channel member 10 has an elongated channel shape configuration defined by a longitudinal axis X as shown in FIGS. 1 and 5. The length of the channel member 10 is substantially greater than the width. Preferably, the channel member 10 is fabricated of metal such as iron or steel or any other suitable material.

Figure 4:
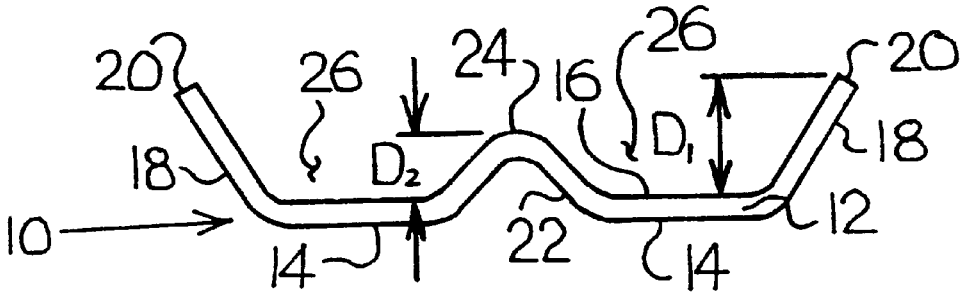
FIG. 4 is an end elevation view of the channel member depicted in FIG. 1.

As shown in FIGS. 1, 4 and 5, the channel member 10 includes a base portion 12 extending the length of the channel member 10 and having a bearing surface 14 for contacting a mine roof and an opposite planar surface 16. A flange 18 extends angularly from each side of the base portion 12. The flanges 18 are formed integral with the base portion 12 and extend laterally the length of the channel member 10. The flanges 18 each terminate in an edge 20. Preferably, the flanges 18 are spaced about five inches apart, and each flange 18 is spaced a preselected distance $D_1$ from the planar surface 16.

The channel member 10 includes a rib 22 integrally formed on the base portion 12. The rib 22 extends the length of the base portion 12 and serves to reinforce the channel member 10. Preferably, the rib 22 is positioned centrally on the planar surface 16 and is formed in a preselected configuration. For example, as illustrated in FIGS. 1 and 4, the rib 22 has a generally V-shaped configuration with an arcuate apex 24 which extends the length of the channel member 10 to form a pair of troughs 26 between the rib 22 and each of the flanges 18. The troughs 26 combined with the rib 22 and the flanges 18 serve to stiffen the channel member 10 to resist bending. A distance $D_2$ from the planar surface 16 to the apex 24 is less than the distance $D_1$ from the planar surface 16 to each of the edges 20. It should be understood that the rib 22 may be embossed on the channel member 10 in any desired configuration to provide the channel member 10 with structural rigidity to resist bending and torsional forces applied by rock strata when installed in a mine.

The channel member 10 includes a plurality of spaced apart openings 28. For purposes of illustration, only one opening 28 is shown in the channel member 10 in FIGS. 1 and 5. However, it should be understood that regardless of the length of the channel member 10, a selected number of openings 28 may be spaced preselected distances apart on the rib 22. In one embodiment, as shown in FIGS. 1 and 5, the openings 28 are defined in the rib 22 and the planar surface 16 and have a length greater than a width to form a slot-like configuration. In an alternate embodiment, the openings 28 are circular in configuration.

The channel members 10 are provided in accordance with the present invention in a number of different lengths that may vary from about four and one half feet to twenty feet. Regardless of the length of the channel member 10, the openings 28 are located a preselected distance apart generally depending on the thickness of the plate.

Figure 2:
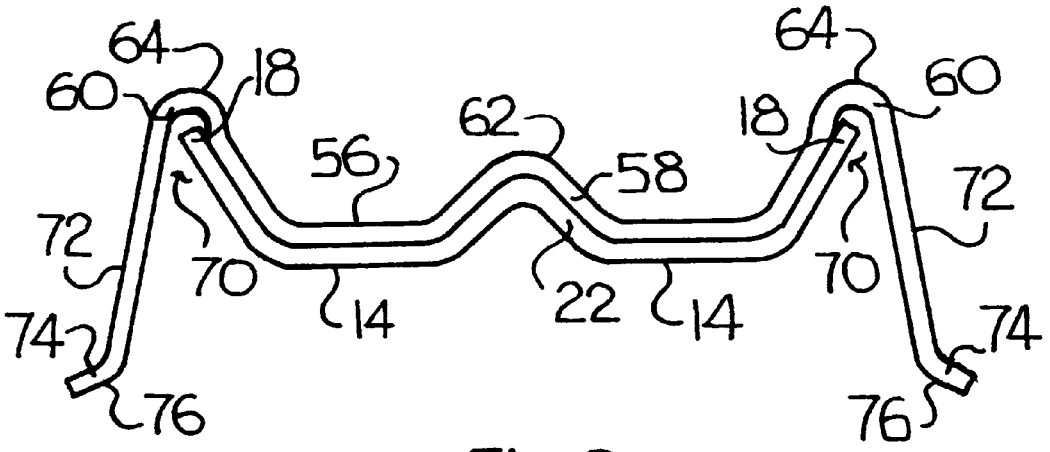
FIG. 2 is an end elevation view of the channel member and the bearing plate depicted in FIG. 1.

As shown in FIGS. 1 and 2, the planar surface 16 together with the flanges 18 and the rib 22 of the channel member 10 form a receiving surface for the bearing plate 50. The bearing plate 50 likewise is fabricated of metal such as iron or steel or any other suitable material. For example, the bearing plate 50 may be fabricated of eight, ten, twelve or fourteen gauge galvanized steel and be supplied in lengths from about six inches to twelve inches. The bearing plate 50 has a generally planar body portion 52 having a longitudinal axis x as shown in FIGS. 1 and 5, a contact surface 54 (shown in FIG. 3) for contacting the planar surface 16 of the channel member 10, and an outer surface 56.

The bearing plate 50 includes a first rib 58 and a pair of second ribs 60. The first rib 58 and the second ribs 60 are each integrally formed on the body portion 52 and extend the length of the body portion 52. Preferably, the second ribs 60 are about five and one-half inches apart with the first rib 58 positioned centrally therebetween. Each of the first and second ribs 58 and 60 preferably have a general V-shaped configuration with respective arcuate apexes 62 and 64 extending the length of the bearing plate 50. The first and second ribs 58 and 60 thus form a pair of troughs 66 between the first rib 58 and the second ribs 60. The troughs 66 combined with the first rib 58 and the second ribs 60 serve to stiffen the bearing plate 50 to resist bending. The V-shaped configurations of the first rib 58 and the second ribs 60 define a first recess 68 and a pair of second recesses 70, respectively. A distance $d_1$ from the outer surface 56 to the second rib apexes 64 is less than a distance $d_2$ from the outer surface 56 to the first rib apex 62. It should be understood that the first rib 58 and the second ribs 60 may be embossed on the bearing plate 50 in any desired configuration to provide the bearing plate 50 with structural rigidity to resist bending and torsional forces applied by the rock strata when installed to support a rock formation, although the configuration of first and second ribs 58 and 60 is determined in part by the configuration of the channel member 10 as detailed further hereinafter.

A pair of legs 72 is integrally attached to and extends from the second ribs 60. A pair of bearing flanges 74 extends angularly from the respective legs 72 and forms a pair of bearing surfaces 76. The distance $d_3$ between the contact surface 54 and a plane formed by a position on each of the bearing surfaces 76 adjacent the legs 72 is determined by the length of the legs 72 and is preselected as described further hereinafter.

Figure 3:
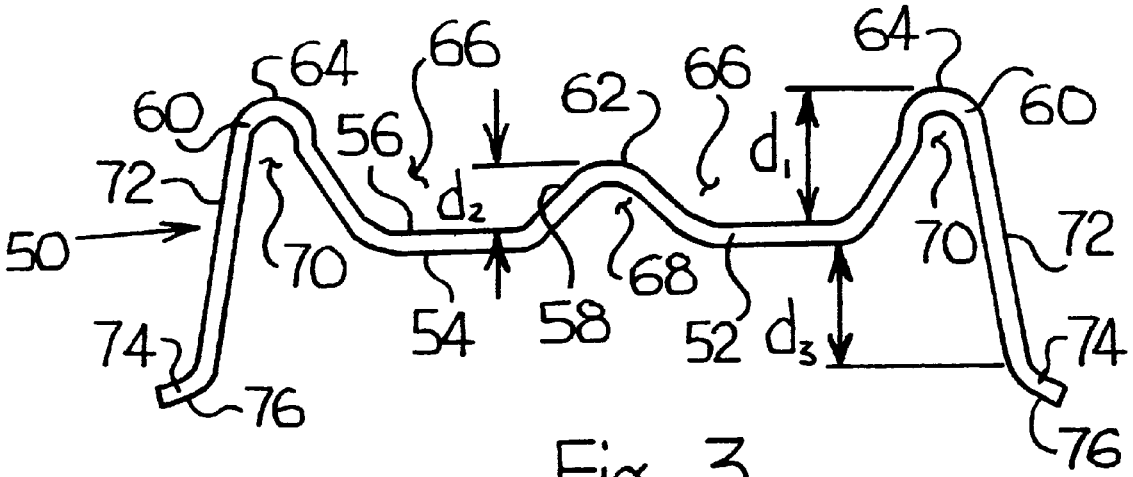
FIG. 3 is an end elevation view of the bearing plate depicted in FIG. 1.

As shown in FIGS. 1 and 5, the bearing plate 50 defines an opening 78 through the first rib 58 and the body portion 52. In one embodiment, the opening 78 has a length greater than a width to form a slot-like configuration. Alternatively, the opening 78 may have a circular configuration. Preferably, the dimensions of the opening 78 in the bearing plate 50 are about equal to the dimensions of the opening 28 in the channel member 10. It should be understood that the bearing plate may also be used without the channel member, as shown in FIG. 3. In this embodiment, the contact surface 54 and the bearing surfaces 76 are configured to be positioned in direct contact with the surface of a rock formation to be reinforced. The configuration of the first and second ribs 58 and 60 provide rigidity to the plate. Therefore, the bearing plate 50 has an overall reinforced structure effective to support a rock formation along with the addition of the channel member 10.

As shown in FIGS. 1 and 3, the channel member 10 and the bearing plate 50 have complementary transverse profiles which permit the bearing plate 50 to be positioned in overlying abutting relation with the channel member 10. The overlying abutting relation of the bearing plate 50 with the channel member 10 forms a composite reinforced channel assembly.

The channel member rib 22 has a configuration complementary with the configuration of the bearing plate first rib 58. This arrangement permits the first bearing plate rib 58 to overlie in abutting relationship with the channel rib 22 thereby resisting lateral movement of the bearing plate 50 on the channel member 10. The bearing plate 50 is further restrained from moving laterally on the channel member 10 by the relationship of the flanges 18 with the second ribs 60 as shown in FIGS. 1 and 2. The flanges 18 each have a configuration so that the edges 20 of the flanges 18 are received within the second recesses 70. Hence, the first rib 58 overlies in abutting relation to the channel member rib 22 and the second ribs 60 overlie the channel member flanges 18. The contact surface 54 provides a substantial surface for engagement with the channel member planar surface 16.

The bearing plate 50 has a generally rectangular channel-like configuration defined by the body portion 52 and the second ribs 60. The bearing plate 50 is wider than the channel member 10. Preferably the bearing plate 50 is about eight and one-half inches wide whereas the channel member 10 is about five inches wide. When the bearing plate 50 is received on the channel member 10 in abutting relation thereto, the channel member flanges 18 are received in the second recesses 70 and the channel rib 22 is received within the first recess 68 such that the flange bearing surfaces 76 and the channel member bearing surface 14 are configured to contact rock strata. The first and second ribs 58 and 60 with the channel rib 22 and the channel flanges 18 combine to provide enhanced rigidity to reinforce the channel member 10.

Preferably, the bearing plate 50 has a minimum length which exceeds the length of the opening 28 in the channel member 10, as shown in FIGS. 1 and 5. In one example, the opening 28 has a length of about three and one-half inches, and the bearing plate 50 has a nominal length of about six inches. Regardless of the configuration of the openings 28 and 78, the bearing plate 50 has a length which provides for substantial overlying relation of the bearing plate contact surface 54 with the channel member planar surface 16. As is explained below in greater detail, the overlying contact of the bearing plate 50 with the channel member 10 assures that the channel member 10 is maintained in compressive relation with the rock strata and is reinforced in the area around the opening 28 to resist lateral and transverse bending of the channel member 10 and to transfer compressive forces to the rock strata surrounding the flange bearing surfaces 76.

During installation, the bearing plate 50 and the channel member 10 are positioned in overlying, abutting relation with the flange bearing surfaces 76 positioned in contact with the rock strata. As shown in FIG. 5, an anchor bolt 100 with a washer 102 is extended through the aligned openings 28 and 78 and into a borehole drilled in the rock formation. The anchor bolt 100 is conventional in design and includes an elongated shank 104 having at one end an integral bolt head 106 and, at an opposite end, a conventional mechanical expansion assembly (not shown) for securing the anchor bolt 100 within the borehole. The washer 102 is sized to cover the openings 28 and 78 and prevents the bolt head 106 from passing through the bearing plate 50. Also, other devices can be used to anchor the bolt 100 in the borehole. For example, a resin system may be utilized to secure the bolt 100 in the borehole by bonding of the bolt 100 to the rock strata surrounding the borehole. Also as well known in the art, a combination expansion shell assembly and resin system can be used to anchor the bolt 100 in the borehole.

With the bearing plate 50 compressed against the channel member 10 and the channel member 10 engaging the surface of the rock strata around the borehole, rotation of the anchor bolt 100 expands the expansion shell assembly into gripping engagement with the wall of the borehole. This places the bolt 100 in tension so that the layers of the rock strata are compressed together. The anchor bolt 100 maintains the channel member 10 and the bearing plate 50 compressed against the surface of the rock strata. The bearing plate body portion 52 is compressed by the anchor bolt 100 against the channel member base portion 12 and the bearing flanges 76 are compressed against the rock strata. Conventionally, boreholes are drilled in the rock strata as a part of the primary cycle in the formation of the underground mine passageway. Thus as the mine passageway is being formed, the channel member 10 and the bearing plates 50 or the bearing plates 50 alone are installed to support the rock strata. The channel members 10 may be installed transversely across the mine roof between the lateral side walls of the mine passageway. The channel members 10 may also be installed to extend vertically on the side walls between the mine roof and floor.

The amount of compressive force applied to the bolt 100 which urges the channel member bearing surface 14 to contact a mine roof is dependent in part on the length of the bearing plate legs 72. In particular, the distance $d_3$ (the length of the legs 72 extending beyond the contact surface 54) preferably is up to about 0.8 inch. Alternatively, the legs 72 may be shorter such that the bearing flanges 74 do not extend beyond the contact surface 54. For example, the bearing flanges 74 may be positioned on the legs 72 at a position intermediate the second rib apex 64 and a plane defined by the contact surface 54.

The channel member 10 and the bearing plate 50 are preferably fabricated by providing a sheet of metal of a predetermined width and stamping the sheet to form the respective flanges 18 and 74 and the respective ribs 22, 58 and 60. The openings 28 and 78 are preferably cut out from the channel member 10 and the bearing plate 50 prior to the stamping step. The channel member 10 and the bearing plate 50 then are cut to the desired lengths.

A modified channel member 110 and a modified bearing plate 150 are depicted in FIGS. 6–10. Channel member 110 includes a base portion 112, a bearing surface 114, a planar surface 116 and a pair of flanges 118 terminating in a pair of edges 120 which are spaced the distance $D_1$ from the planar surface 116. A pair of ribs 122 are integrally formed on the base portion 112 and extend the length of the base portion 112 to reinforce the channel member 110. The ribs 122 each preferably have a V-shaped configuration with an arcuate apex 124 spaced the distance $D_2$ from the planar surface 116. The pair of ribs 122 preferably are spaced equidistant from the longitudinal axis X about four and one-half inches apart thereby forming three troughs 126. A plurality of spaced apart openings 128 (only one being shown in FIGS. 6 and 7) are defined in the base portion 116 preferably along the longitudinal axis X.

The planar surface 116 acts as a receiving surface for the bearing plate 150. The bearing plate 150 includes a body portion 152, a contact surface 154 and an outer surface 156. A pair of first ribs 158 and a pair of second ribs 160 are integrally formed on the body portion 152 and extend the length of the body portion 152. First and second ribs 158 and 160 preferably have a general V-shaped configuration with respective arcuate apexes 162 and 164 extending the length of bearing plate 150 to form three troughs 166. The second ribs 160 preferably are spaced about nine inches apart. The distance $d_1$ from the outer surface 156 to the first apexes 162 is less than the distance $d_2$ from the outer surface 156 to the second apexes 164. The V-shaped configurations of the first ribs 158 and the second ribs 160 define respective first recesses 168 and second recesses 170. The bearing plate 150 further includes a pair of legs 172 and a pair of bearing flanges 174 with bearing surfaces 176. An opening 178 is defined in the body portion 152, preferably centered on the longitudinal axis x between the first ribs 158.

Figure 6:
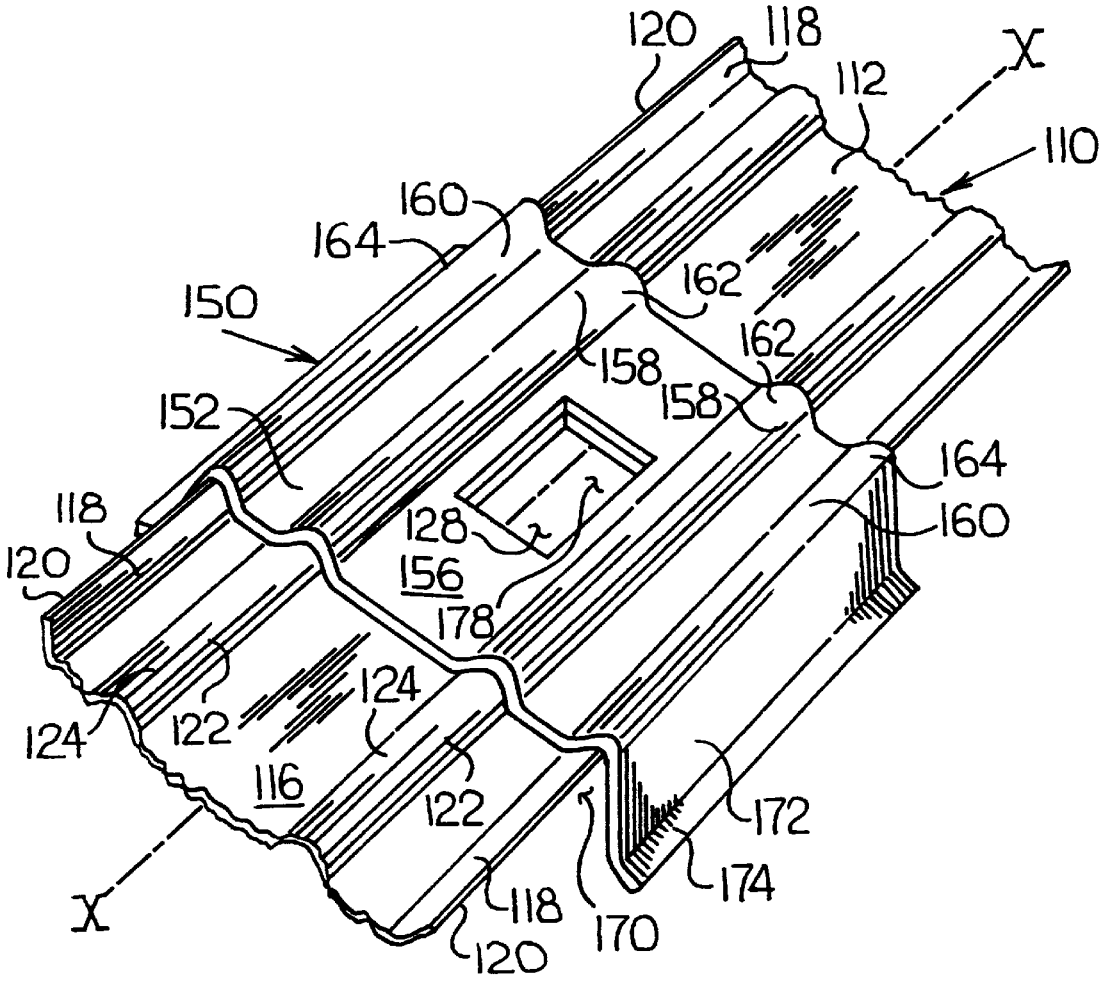
FIG. 6 is a top perspective view of a modified channel member and a modified bearing plate made in accordance with the present invention in overlying abutting relation.
Figure 7:
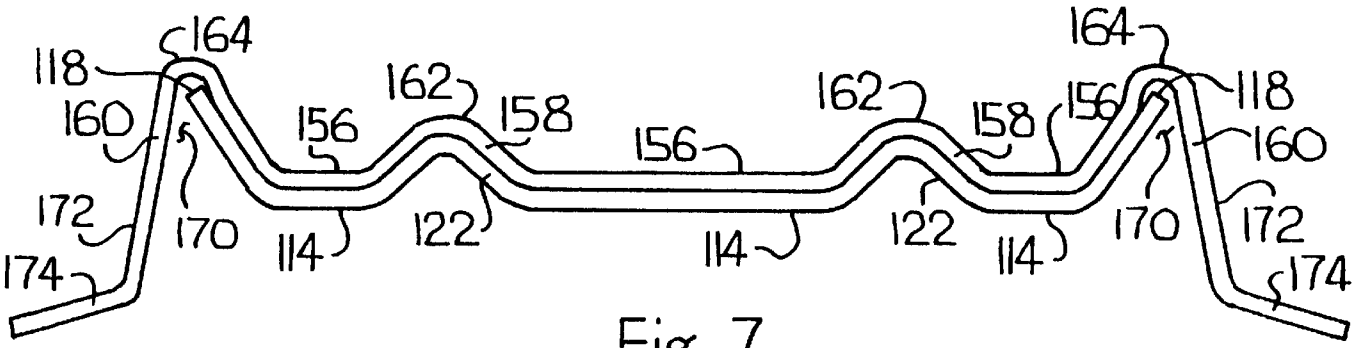
FIG. 7 is an end elevation view of the modified channel member and the modified bearing plate depicted in FIG. 6.
Figure 8:
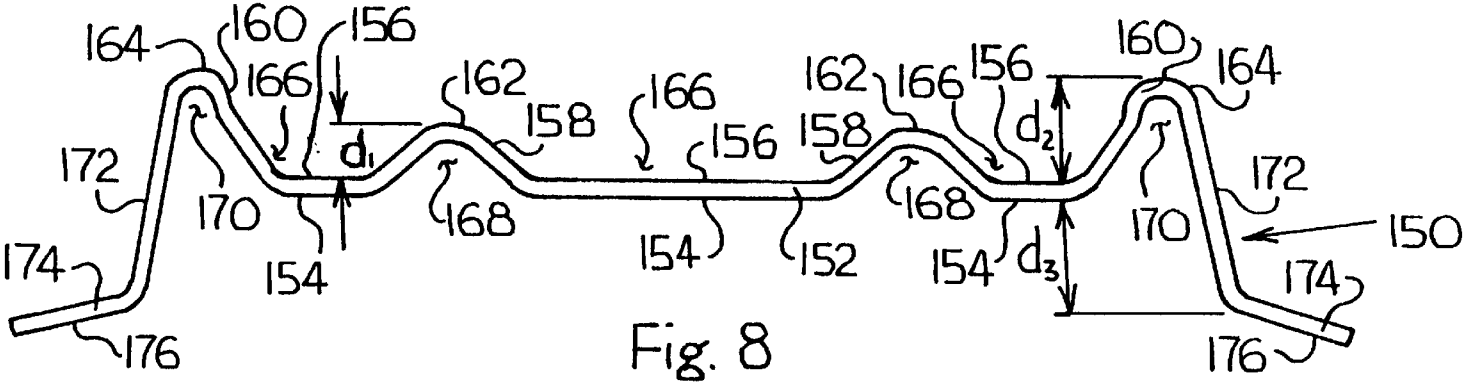
FIG. 8 is an end elevation view of the modified bearing plate depicted in FIG. 6.
Figure 9:
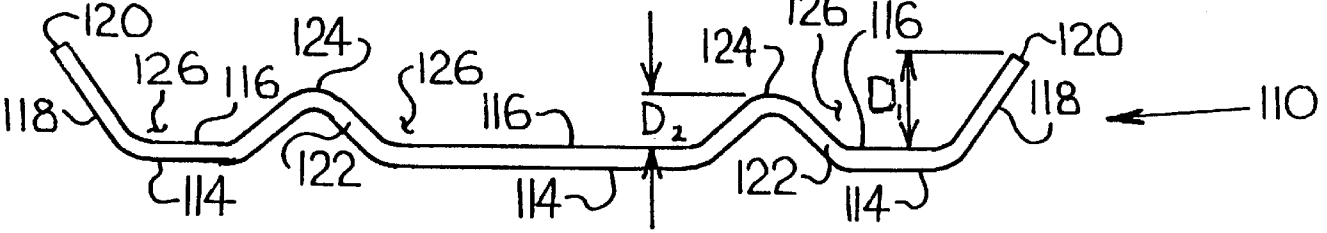
FIG. 9 is an end elevation view of the modified channel member depicted in FIG. 6.

As shown in FIGS. 6 and 7, similar to the channel member 10 and the bearing plate 50, the channel member 110 and the bearing plate 150 have complementary transverse profiles which permit the bearing plate 150 to be overlaid in abutting relation to the channel member 110 to form a composite reinforced channel assembly. The channel member first ribs 122 are adapted to be received within the first recesses 168 of the bearing plate 150. The flanges 118 are adapted to be received within the second recesses 170. The openings 128 and 178 are preferably aligned with each other.

Figure 10:
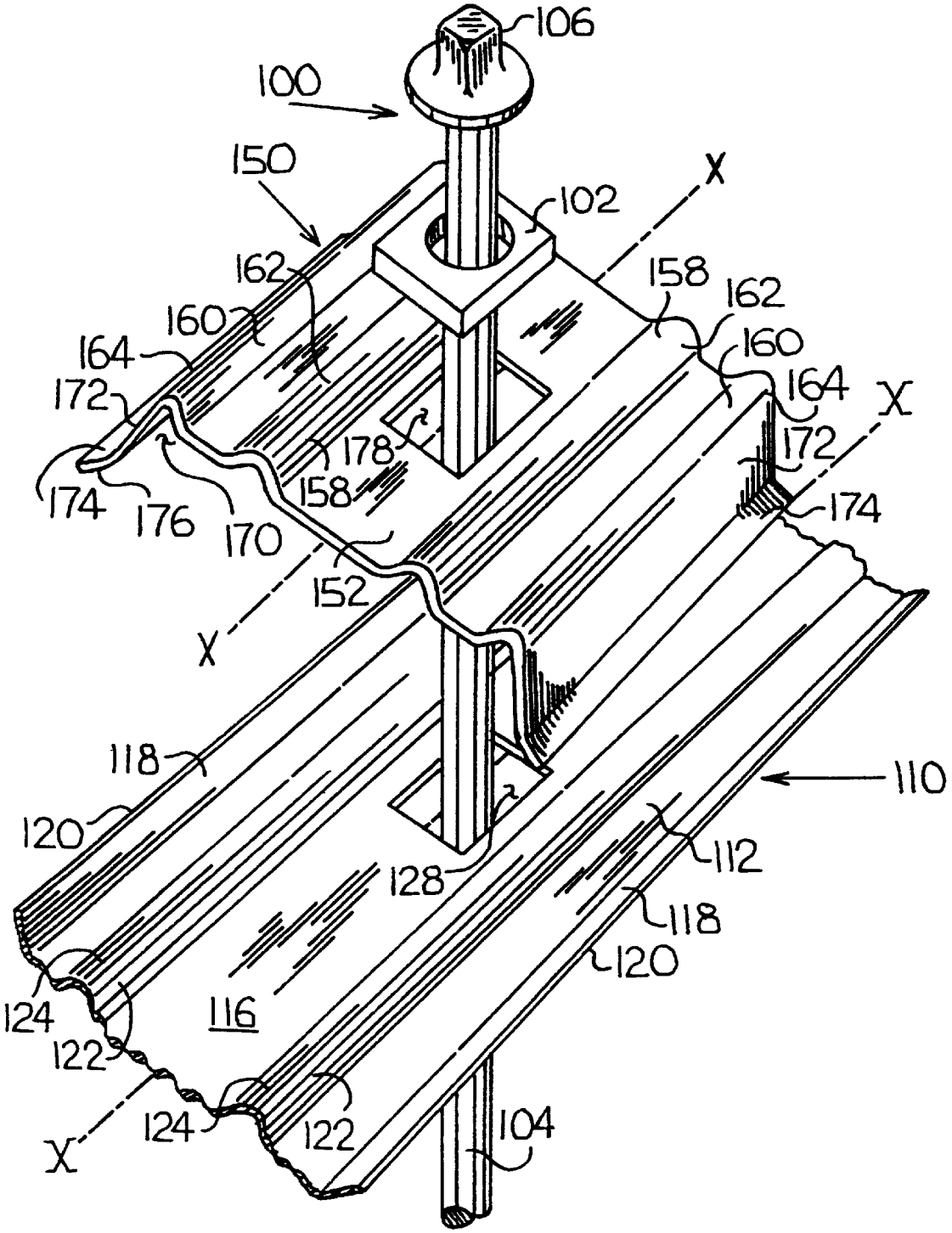
FIG. 10 is an exploded perspective view of an assembly of an anchor bolt and a washer with the modified channel member and the modified bearing plate depicted in FIG. 6.

As shown in FIG. 10, the channel member 110 and the bearing plate 150 are adapted to be installed in a mine passage with a rock anchor bolt 100 and a washer 102 in a manner similar to the channel member 10 and the bearing plate 50. Upon installation, the contact surface 154 compresses against the planar surface 116. The flange bearing surfaces 176 alone or with the bearing surface 114 engage the surface of the rock strata around the borehole. The length of the legs 172 may vary as described above regarding the legs 72 of the bearing plate 50 to vary the amount of compressive force required to engage the flange bearing surfaces 176 and the bearing surface 114 with the surface of the rock strata. The channel member 110 is preferably about nine inches wide and the bearing plate 150 is preferably about thirteen inches wide and are each formed from similar materials as those of the channel member 10 and the bearing plate 50 and fabricated in a similar manner.

Figure 11:
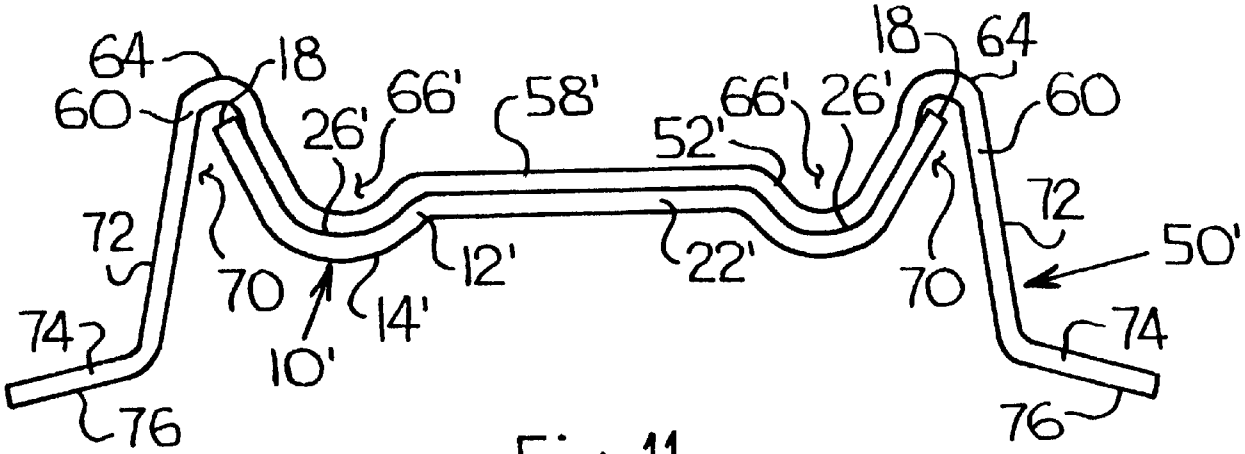
FIG. 11 is an end elevation view of another channel member and another bearing plate made in accordance with the present invention in overlying abutting relation.

FIG. 11 depicts a further modified channel plate 10' and a bearing plate 50'. The channel plate 10' includes a base portion 12' having a bearing surface 14' and a rib 22' having an opening (not shown). A pair of flanges 18 is integrally formed with the base portion 12' to define a pair of troughs 26'. The bearing plate 50' includes a body portion 52' with a first rib 58'. A pair of second ribs 60 with arcuate second rib apexes 64 is integrally formed with the body portion 52' to define a pair of troughs 66'. The second ribs 60 preferably have a V-shaped configuration and define a pair of recesses 70 which are adapted to receive the flanges 18. A pair of legs 72 extend from the second ribs 60 and is integrally formed with a pair of flanges 74 having bearing surfaces 76. The channel member 10' and the bearing plate 50' have complementary transverse profiles which, similar to the channel member 10 and the bearing plate 50, permit the bearing plate 50' to be positioned in overlying abutting relation with the channel member 10' and used in a similar manner.

Figure 12:
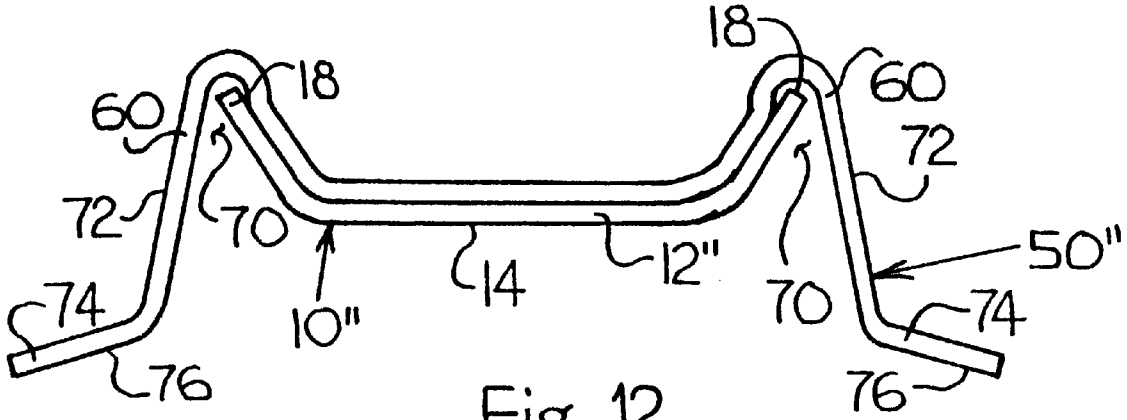
FIG. 12 is an end elevation view of yet another channel member and yet another bearing plate made in accordance with the present invention in overlying abutting relation.

FIG. 12 depicts yet another modified channel member 10" and a bearing plate 50". The channel member 10" does not include any ribs but has a base portion 12" with integral flanges 18 and an opening (not shown). The bearing plate 50" includes a pair of ribs 60 integrally formed with a pair of legs 72 and a pair of flanges 74 having bearing surfaces 76. The ribs 60 preferably have a V-shaped configuration to define recesses 70 which are adapted to receive the flanges 18. The channel member 10" and the bearing plate 50" have complementary transverse profiles similar to the respective channel members 10 and 10' and the bearing plates 50 and 50' which permit the bearing plate 50" to be positioned in overlying abutting relation with the channel member 10" and to be used in a similar manner.

The bearing plates 50 (and 50' and 50") and 150 and the channel members 10 (and 10' and 10") and 110 as well as the reinforcing portions thereon serve to provide compressive forces on a mine roof heretofore not achieved by conventional channel members and bearing plates. The combination of the bearing plates of the present invention with the inventive channel members provides flexibility thereof during loading with an anchor bolt. The second ribs 60 and 160 along with the respective legs 72 and 172 and the flanges 74 and 174 may deflect to spread the final width of the inventive bearing plates upon loading or upon subsequent shift of the supported rock strata. The amount of deflection or spreading of the bearing plates may be indicative of the degree of shifting of the rock strata. The ability to deflect or spread is believed to be particularly useful in underground mines requiring a stress relief mechanism, i.e., in mines containing highly elastic materials such as trona and potash.

In addition to their uses in a composite reinforced channel assembly, the bearing plates 50 (or 50' or 50") and 150 each may also be used as a load indicator or as a center span support. Although the use of the bearing plate 50 is discussed hereinafter, it should be understood that bearing plates 50', 50" and 150 may be used in similar manners.

When used as a load indicator, the bearing plate 50 is installed in overlying abutting relation with the channel plate 10 and the anchor bolt 100 as depicted in FIG. 5. Installation is complete when the bearing surface 14 and the flange bearing surfaces 76 contact the rock strata. If the load borne by the anchor bolt 100 increases due to a shift in the support rock strata, the bearing flanges 74 will be urged away from each other thereby expanding or widening the recesses 70 and changing the configuration of the ribs 60. The distance that the bearing flanges 74 move apart and/or the change in the configuration of the ribs 60 depends at least on the material properties of the bearing plate 50, the thickness of the bearing plate 50 and the particular configuration of the V-shaped ribs 60. The distance moved by the bearing flanges 74 and the change in the configuration of the ribs 60 may be correlated with known applied loads for the particular bearing plate 50 used as an indication of the load exerted by the supported rock strata.

Alternatively, the bearing plate 50 may be installed with a channel member and an anchor bolt 100 such that the ribs 58 and 60, respectively, bear against the rock surface and channel member. In such an installation, the bearing plate 50 is believed to provide greater support to the supported rock strata than is achieved when the ribs 58 and 60 extend away from the rock surface. This is particularly useful for supporting the central portion of a span across a mine passageway.

It will be readily appreciated by those skilled in the art that modifications may be made to the invention without departing from the concepts disclosed in the foregoing description. Such modifications are to be considered as included within the following claims unless the claims, by their language, expressly state otherwise. Accordingly, the particular embodiments described in detail herein are illustrative only and are not limiting to the scope of the invention which is to be given the full breadth of the appended claims and any and all equivalents thereof.

I claim:

1. A bearing plate comprising:

a planar body portion positioned in a plane, said planar body portion having a contact surface for abutting a planar surface and an outer surface on an opposite side of said body portion, said body portion defining an opening through said bearing plate;

a pair of spaced apart peripheral ribs formed in said body portion, each said peripheral rib extending outwardly from said outer surface and defining a recess; and a pair of legs, each said leg being integrally formed with one of each said peripheral ribs, wherein each said leg extends from each respective said peripheral rib in a direction away from said contact surface and each said leg passes in the same direction through the plane of said planar body portion.

2. The bearing plate as claimed in claim 1 further comprising a pair of flanges, each said flange extending angularly from one of said legs and having a flange bearing surface for engaging a rock formation.

3. The bearing plate as claimed in claim 2, wherein said flanges each extend to a depth below said contact surface.

4. The bearing plate as claimed in claim 1 further comprising a central rib formed in said body portion and positioned between said pair of peripheral ribs, wherein said opening is defined in said central rib.

5. The bearing plate as claimed in claim 4, wherein said peripheral ribs are spaced about five and one-half inches apart.

6. The bearing plate as claimed in claim 4, wherein said peripheral ribs each extend a greater distance from said outer surface than said central rib extends from said outer surface.

7. The bearing plate as claimed in claim 1 further comprising a plurality of inner ribs formed in said body portion at spaced apart positions between said peripheral ribs, such that said opening is defined in said body portion at a position between said inner ribs.

8. The bearing plate as claimed in claim 7, wherein said peripheral ribs are spaced about nine inches apart.

9. The bearing plate as claimed in claim 7, wherein said peripheral ribs each extend a greater distance from said outer surface than each said inner rib extends from said outer surface.

10. A mine roof support assembly comprising:

a) an elongated member having (i) a base portion, and (ii) a pair of longitudinal flanges on opposite sides of said base portion, said base portion having a bearing surface and a receiving surface and defining an opening through said elongated member;

b) a bearing plate having (i) a planar body portion, said body portion including a contact surface for abutting said elongated member receiving surface and an outer surface on an opposite side of said body portion, said body portion defining an opening through said bearing plate, said body portion opening aligned with said elongated member opening, (ii) a pair of spaced apart peripheral ribs formed in said body portion, each said peripheral rib extending outwardly from said outer surface and defining a recess configured to receive one of said elongated member flanges, and (iii) a pair of legs, each said leg integrally formed with one of said peripheral ribs; and c) an anchor extending through said aligned openings and configured to be inserted into a borehole in a rock formation for engaging said bearing plate and said elongated member with the rock formation to support a load applied by the rock formation.

11. The mine roof support assembly as claimed in claim 10, wherein said bearing plate further comprises a pair of flanges, each said bearing plate flange extending angularly from one of said legs and having a flange bearing surface for engaging the rock formation.

12. The mine roof support assembly as claimed in claim 10, wherein said elongated member further comprises a central rib formed in said base portion and said bearing plate further comprises a central rib formed in said body portion in a configuration complementary to said elongated member central rib such that said aligned openings are defined in said respective central ribs.

13. The mine roof assembly as claimed in claim 12, wherein said bearing plate peripheral ribs and said elongated member longitudinal flanges each extend greater distances from said bearing plate outer surface than said central rib extends from said bearing plate outer surface.

14. The mine roof support assembly as claimed in claim 10, wherein said elongated member further comprises a plurality of inner ribs formed in said base portion and said bearing plate comprises a plurality of inner ribs formed in said body portion, said bearing plate inner ribs having configurations complementary to said elongated member inner ribs, said aligned openings being defined in said base portion and said body portion between said respective inner ribs.

15. The mine roof assembly as claimed in claim 14, wherein said bearing plate peripheral ribs and said elongated member longitudinal flanges each extend greater distances from said bearing plate outer surface than said bearing plate inner ribs extend from said bearing plate outer surface.

16. The mine roof assembly a s claimed in claim 10, wherein said bearing plate peripheral ribs are each configured to spread thereby widening said recesses upon engaging said bearing plate with the rock formation.

17. The mine roof assembly as claimed in claim 10, wherein said bearing plate peripheral ribs are each configured to spread thereby widening said recesses when said assembly receives a change in a load applied by the rock formation.

18. A method of supporting a rock formation comprising the steps of:

positioning a bearing plate in overlying abutting relation with an elongated member, the bearing plate and the elongated member each having an aligned opening therethrough and the bearing p late having a pair of peripheral ribs formed therein, the ribs each defining a recess;

positioning longitudinal flanges on opposing sides of the elongated member within the recesses in the bearing plate; and extending an anchor through the aligned openings in the bearing plate and urging the elongated member into engagement with the rock formation thereby urging the bearing plate into contact with a surface of the rock formation.

19. The method as claimed in claim 18, wherein the bearing plate includes flanges integrally formed with the peripheral ribs, the flanges having bearing surfaces which contact the rock formation surface such that the recesses widen upon urging the bearing plate into contact with the rock formation surface.

20. The method as claimed in claim 19, further comprising the step of urging a surface of the elongated member into contact with the rock formation surface.

21. A method of indicating the amount of load applied by a supported rock formation comprising the steps of:

positioning a bearing plate in overlying abutting relation with an elongated member, the bearing plate having a pair of peripheral ribs formed therein, the peripheral ribs each defining a recess and being integrally formed with a pair of bearing surfaces for engaging a rock formation, the elongated member having a bearing surface for engaging the rock formation and a pair of opposing longitudinal flanges, the bearing plate and the elongated member each having an aligned opening therethrough;

positioning the longitudinal flanges within the recesses in the bearing plate;

extending an anchor through the aligned openings in the bearing plate and the elongated member into engagement with the rock formation thereby urging the bearing surfaces of the bearing plate and the bearing surface of the elongated member into contact with a surface of the rock formation;

determining a first configuration of the bearing plate recesses;

allowing the load of the rock formation to shift thereby inducing a second configuration of the bearing plate recesses; and comparing the change between the first recess configuration and the second recess configuration to a predetermined standard for a load required to affect the change.

22. A bearing plate comprising:

a planar body portion having a contact surface for abutting a planar surface and an outer surface on an opposite side of said body portion;

a pair of spaced apart peripheral ribs formed in said body portion, each said peripheral rib extending outwardly from said outer surface and defining a recess;

a central rib formed in said body portion and positioned between said pair of peripheral ribs, wherein said central rib defines an opening through said bearing plate and said peripheral ribs each extend a greater distance from said outer surface than said central rib extends from said outer surface; and a pair of legs, each leg being integrally formed with one of said peripheral ribs.

23. A bearing plate comprising:

a planar body portion having a contact surface for abutting a planar surface and an outer surface on an opposite side of said body portion, said body portion defining an opening through said bearing plate;

a pair of spaced apart peripheral ribs formed in said body portion, each said peripheral rib extending outwardly from said outer surface and defining a recess;

a plurality of inner ribs formed in said body portion in spaced apart positions between said peripheral ribs, such that said opening is defined in said body portion at a position between said inner ribs; and a pair of legs, each leg being integrally formed with one of said peripheral ribs, wherein said peripheral ribs each extend a greater distance from said outer surface than each said inner rib extends from said outer surface.

* * * * *